US005235769A

United States Patent [19]

Stead et al.

[11] Patent Number: 5,235,769

[45] Date of Patent: Aug. 17, 1993

[54] PUMP FIREARM HAVING A FORWARDLY MOVING BARREL

[76] Inventors: Heyns W. Stead, 227 Antares Street, Waterkloof, Pretoria, Transvaal Province; Anthony S. Neophytou, 154 Monument Avenue, Verwoerdburg, Transvaal Province, both of South Africa

[21] Appl. No.: 786,083

[22] Filed: Oct. 31, 1991

[30] Foreign Application Priority Data

Nov. 5, 1990 [ZA] South Africa ..... 90/8848

[51] Int. Cl.[5] ..... F41A 9/15

[52] U.S. Cl. ..... 42/11; 42/50

[58] Field of Search ..... 42/10, 11, 50; 89/161

[56] References Cited

U.S. PATENT DOCUMENTS

| | | | |
|---|---|---|---|
| 822,851 | 6/1906 | Burgess | 42/11 |
| 1,429,370 | 9/1922 | Putnam | 89/161 |
| 3,997,994 | 12/1976 | Kaestner et al. | 42/9 |

OTHER PUBLICATIONS

Longitudinal cross-sectional illustration of Schwarzlose pistol of 1893.

Description and two illustrations of Schwarzlose pistol .32 M1909 of ca. 1909.

Illustrations of Mannlicher pistol of 1894.

"Belgium," *International Defense Review*, vol./No. 2 (1991).

Fencl, J. "The Czechoslovak ZB47 Submachine Gun," *Guns Review* (Feb. 1990), pp. 116–118.

*Primary Examiner*—Michael J. Carone

*Attorney, Agent, or Firm*—Ladas & Parry

[57] ABSTRACT

A pump action firearm includes a barrel and a chassis defining a magazine well for receiving a magazine. The magazine well extends longitudinally parallel to the barrel and contains a plurality of cartridges arranged in stacked relationship with each cartridge having its longitudinal axis extending substantially transversely to a longitudinal axis of the barrel. A pump member displaces the barrel forwardly and rearwardly. A carrier mechanism is linked to the pump member and, during pumping of the pump member, moves an end cartridge contained in the magazine from its stacked position to an operative position in alignment with the longitudinal axis of the barrel.

9 Claims, 9 Drawing Sheets

PUMP FIREARM HAVING A FORWARDLY MOVING BARREL

This invention relates to a firearm and in particular to a pump action firearm.

According to the invention there is provided a pump action firearm which includes a barrel, a chassis defining a magazine well for receiving a magazine, the magazine well extending longitudinally parallel to the barrel and operable to contain a plurality of cartridges arranged in stacked relationship with each cartridge having its longitudinal axis extending substantially transversely to a longitudinal axis of the barrel, a pump member operable to displace the barrel forwardly and rearwardly, and a carrier mechanism linked to the pump member and operable, during pumping of the pump member, to move an end cartridge contained in the magazine from its stacked position to an operative position in alignment with the longitudinal axis of the barrel.

The carrier mechanism may include at least one gripping formation operable to receive the end cartridge contained in the magazine, the gripping formation being fixed to a carrier member which is tiltable by the pump member thereby to displace the end cartridge from its stacked position to its operative position in alignment with the barrel. The gripping formation may include a pair of gripping arms for receiving the end cartridge therebetween, the arms co-operating with a camming face provided in a butt of the firearm and operable to allow the arms to open to receive the end cartridge therebetween as the arms approach the end cartridge and then to close the arms thereby to grip the end cartridge during a subsequent pumping action thereby to permit transfer of the end cartridge from the magazine to its operative position in alignment with the barrel.

The firearm may further include a retaining mechanism operable to retain the cartridge in its operative position in alignment with the barrel to permit proper chambering of the cartridge in the barrel prior to firing and operable to prevent movement of the cartridge when the barrel is moved forwardly after firing, the retaining mechanism including a pair of extractor members operable to engage a rim of the cartridge and to urge it against a breech face provided in the butt, and a non return latch operable to prevent return of the cartridge towards the magazine when the carrier mechanism is returned to collect a further cartridge on a return stroke of the pump member.

The magazine is conveniently removably insertable in the magazine well. The magazine well may be located below the barrel or above the barrel. When rimmed cartridges are loaded in the magazine, the magazine may have a longitudinally extending wider portion to accommodate the rims, alternate stacked cartridges then being arranged in the magazine in tilted positions in planes extending at an acute angle relative to each other. Displacement of the cartridges towards the mouth of the magazine may be effected by means of a tape-like spring operable to urge the cartridges towards the rear end. The magazine may have side walls which taper inwardly towards its mouth to orientate the end cartridge to a central position intermediate its extreme tilted positions as it approaches the mouth of the magazine.

In one embodiment, the magazine may have a catch located at its mouth and operable to retain the end cartridge in the mouth of the magazine, the catch being displaceable by a forwardly protruding finger provided on the carrier member as it approaches the mouth of the magazine thereby to permit the end cartridge to exit the mouth and to be received between the gripping arms. In another embodiment, the magazine may have a flap, eg extending along at least portion of its upper face, the flap being displaceable outwardly to facilitate loading of cartridges in the magazine. The flap may co-operate with at least one cam formation located on a slide of the firearm, the cam being operable to displace the flap out of the path of an end cartridge during transference of the cartridge from the magazine to the carrier mechanism.

Once inserted in the magazine well, the magazine may be retained therein by a catch formation which is displaceable to permit removal of the magazine from the magazine well.

In one embodiment, the barrel may be supported at its rear end by a collar and at its forward end by a transverse pin engaging in a slot defined in the pump member, the slot being operable to displace the barrel during forward movement of the barrel from a locked position with a forward end of the barrel abutting against a locking formation, to an unlocked position with the forward end of the barrel clear of the locking formation during the pumping action.

In another embodiment, the barrel may be supported at its forward end by a collar provided in a chassis of the firearm and by a barrel lock intermediate its ends. The barrel lock may be in the form of a semi-circular collar rotatably mounted on the barrel and axially located between two spaced collars fixed to the barrel. The barrel lock may have a depending lug which rides in an elongated slot provided in the chassis, the slot having at one end a cam formation operable to cam the barrel lock into its locked position. The barrel lock may further have a cam slot formed in its wall, the slot being engaged by a pin fixed to the pump member thereby to cause unlocking of the barrel lock during pumping of the pump member.

The firearm may include an ejector mechanism for ejecting a casing of the cartridge after firing. In one embodiment, the ejector mechanism may include an ejector finger which is displaceable by an ejection cam provided on the barrel thereby to displace the casing laterally after firing. The barrel may have a pair of ejection cams so that the casing can be ejected to the left or right of the barrel dependent upon whether a person firing the firearm is right or left handed. The casing can be ejected via a pair of ports, the ports having a removable gate for closing off one or other of the ports.

In another embodiment, the ejector mechanism may include a pair of ejection fingers fixed to the carrier mechanism in which case the chassis may have a single ejection port in alignment with the carrier mechanism, the ejection fingers being operable to eject a spent cartridge via the ejection port while the carrier mechanism carries a fresh cartridge from the magazine into a position in alignment with the barrel.

Various embodiments of the invention are now described by way of example with reference to the accompanying drawings, in which.

Figure 4:
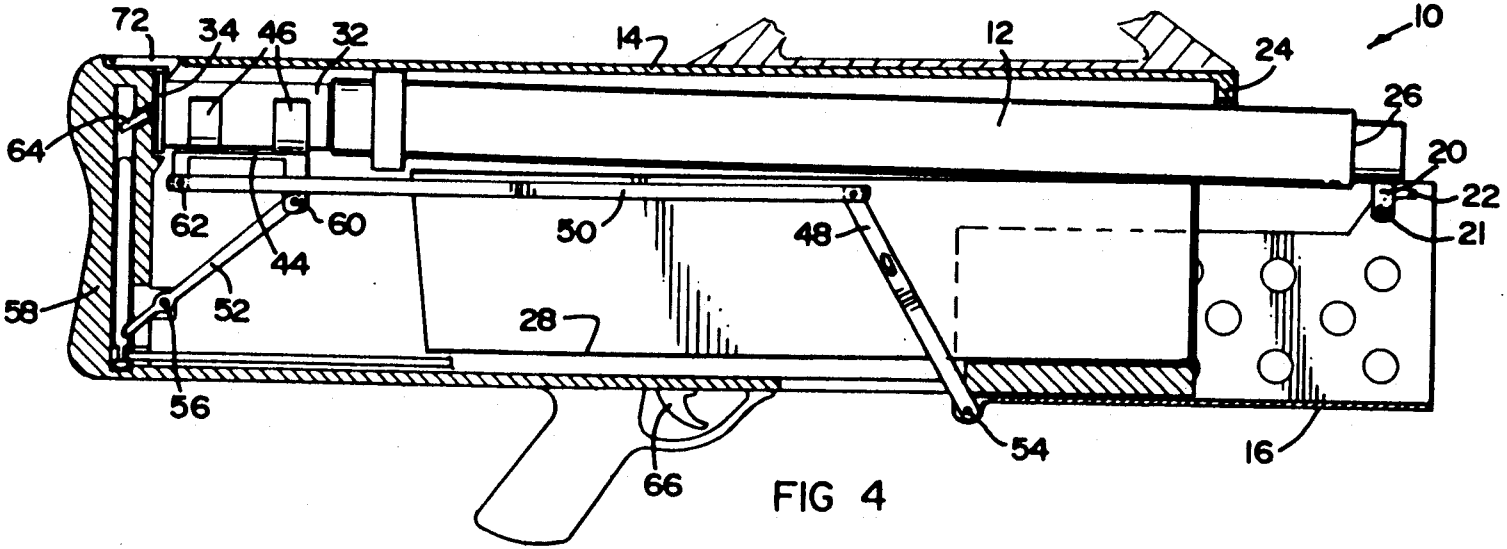

Referring to FIGS. 1 to 7, reference numeral 10 generally indicates a firearm in the form of a pump action shotgun. The firearm has a barrel 12 located in an upper portion of a chassis 14. The barrel 12 is displaceable from an operative firing position shown in FIGS. 1, 2 and 3 to a loading position as shown in FIG. 4 by displacement of a pump member 16. The barrel 12 is supported at its rear end by a collar 18 and at its forward end by means of a link 20 fixed to and depending downwardly from the barrel 12. The link 20 has a transverse pin 21 which engages a cam slot 22 in the pump member 16 (see FIGS. 3 and 4). When in its firing position, an abutment formation 24 integrally formed with the chassis 14 engages a step 26 on the forward end of the barrel. When the pump member 16 is moved forwardly, the forward end of the barrel 12 first moves downwardly to clear the abutment formation 24 whereafter it can move forwardly to the position shown in FIG. 4, the pin 21 sliding downwardly into the lower end of the slot 22 during such forward movement.

Figure 5:
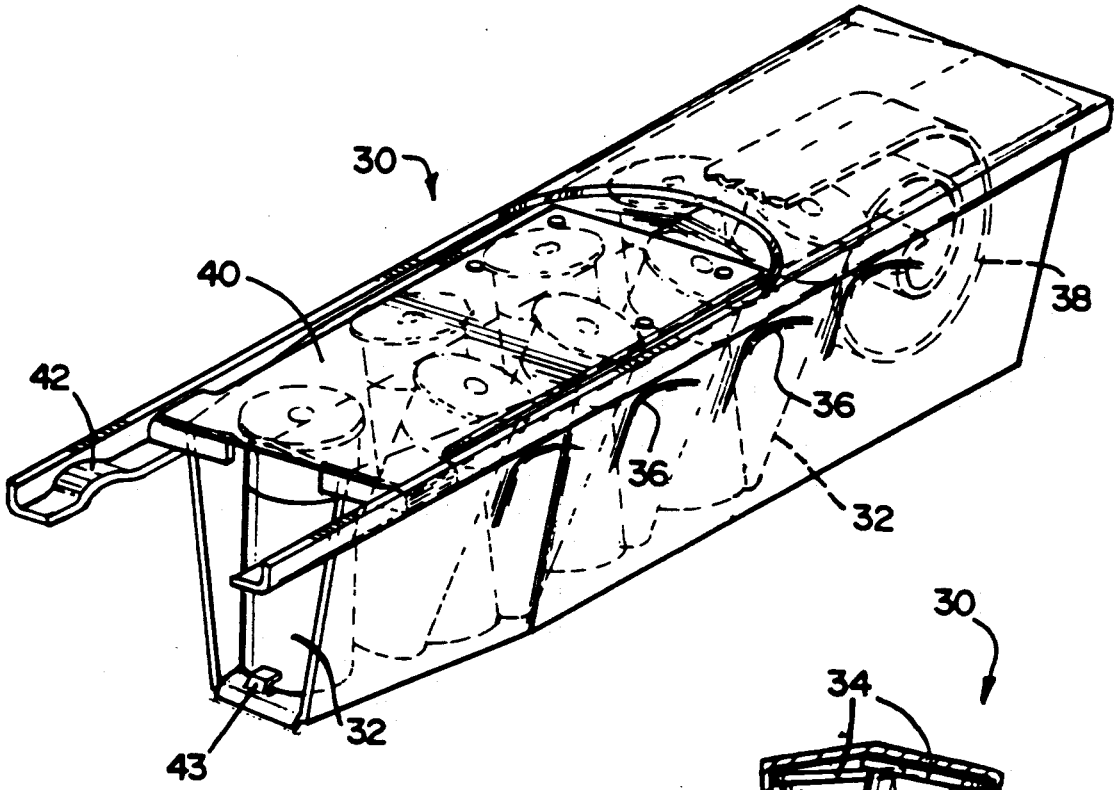
FIG. 5 shows a three dimensional view of a magazine used in the firearm.
Figure 6:
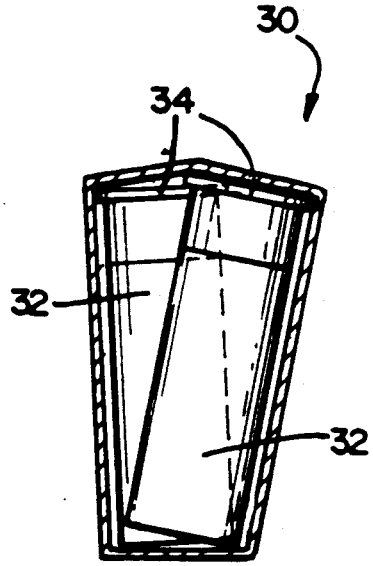
FIG. 6 shows an end view of the magazine of FIG. 5.

The firearm has a magazine well 28 in its lower forward portion for receiving a magazine 30, details of which are shown in FIGS. 5 and 6. As shown in FIGS. 5 and 6, cartridges 32 are arranged transversely to the barrel with the longitudinal axis of each cartridge 32 extending substantially transversely to a longitudinal axis of the barrel. In order to accommodate the wider rims 34 on each cartridge, the magazine 30 is, in this embodiment, broader at its upper end than at its lower end. Also, the magazine allows each alternate cartridge to tilt to opposite extreme positions as is more clearly shown in FIG. 6 while the cartridges are urged towards the mouth of the magazine 30 by a tape like spring 38.

The magazine has a flap 40 on its upper rearward end which is resiliently displaceable upwardly either manually when the cartridges are being loaded into the magazine, or by a cam formation 42 which lifts the flap clear of the rearmost cartridge 32 when the pump member 16 is actuated. The magazine also has a stop member 43 in the path of a lower end of the rearmost cartridge 32 and which is also displaceable by a cam (not shown) out of the path of the lower end of the cartridge when the pump member is actuated. One end of the tape like spring 38 is fixed by rivets (not shown) to the flap 40. The magazine 30 also tapers inwardly at its mouth to orientate the end cartridge to an upright position intermediate the two tilted positions. The magazine 30 has a carrying handle (not shown) on its forward face and is retained in the chassis 14 by a simple catch (also not shown).

A carrier mechanism including a carrier member 44 having a pair of gripping formations 46 thereon, is provided within the chassis 14 rearwardly of the magazine 30. The gripping formations 46 will grip the rearmost cartridge 32 when the pump member 16 is actuated to tilt the cartridge from the position shown in FIG. 3 to a position in alignment with the barrel 12 as shown in FIG. 4. Tilting of the carrier mechanism is effected by means of a system of levers 48, 50 and 52. The levers 48 have one end pivotally attached at 54 to the pump member 16 while the lever 52 is pivotally connected at 56 to a butt 58 provided at the rear end of the chassis 14. The lever 52 is furthermore pivotally connected at 60 to the carrier member 44 while the levers 50 are pivotally connected at 62 to the carrier member 44. The levers 50 are supported by guide formations (not shown) to prevent lateral movement of the levers 50.

The butt 58 furthermore accommodates a firing pin 64 which is of conventional form and causes the cartridge 32 when located in the rear end of the barrel 12 to be fired upon operation of a trigger 66. It will be noted that the firearm does not have a reciprocating bolt and that a breech face is provided by a forward face of the butt 58.

The trigger 66 is surrounded by a trigger guard 68 and has a pistol grip 70.

The cartridge 32 when it is moved into the position shown in FIG. 4, is retained by a retaining member 72 which engages the rim 34 of the cartridge. The retaining member 72 has a leading end which is cammed out of the way of the cartridge as the cartridge moves towards the position shown in FIG. 4. The retaining member 72 serves to retain the cartridge 32 in its position in alignment with the barrel 12 when the carrier member 44 returns to collect a further cartridge after firing.

Figure 1:
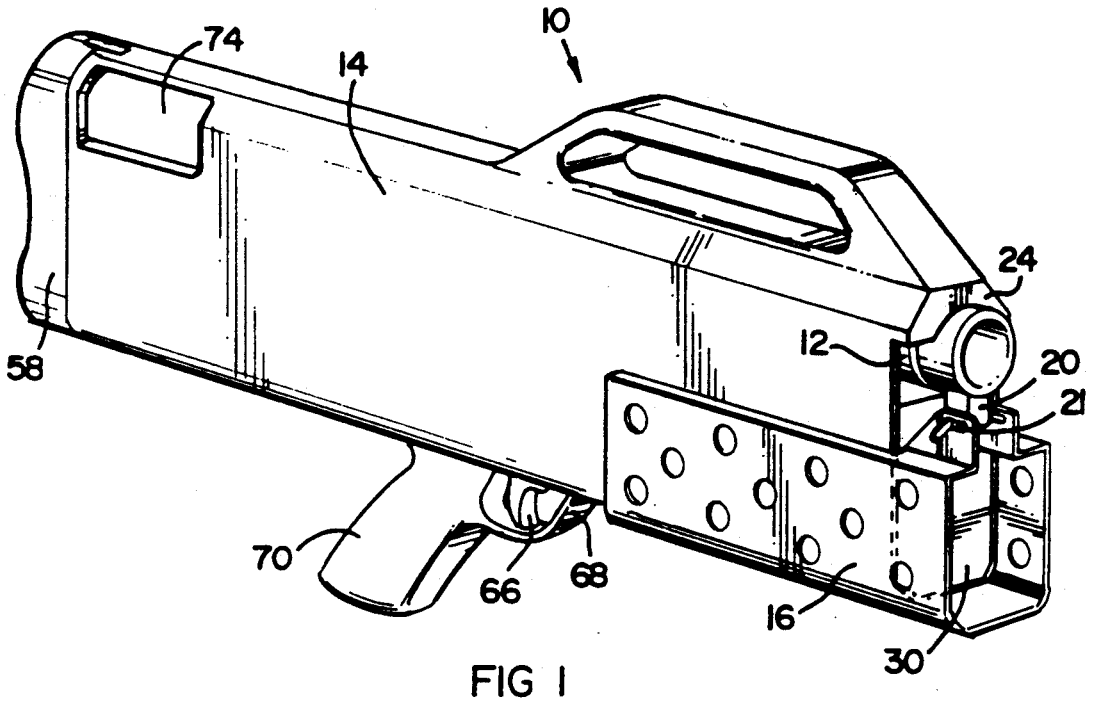
FIG. 1 shows a schematic three dimensional view of a firearm in accordance with the invention.
Figure 2:
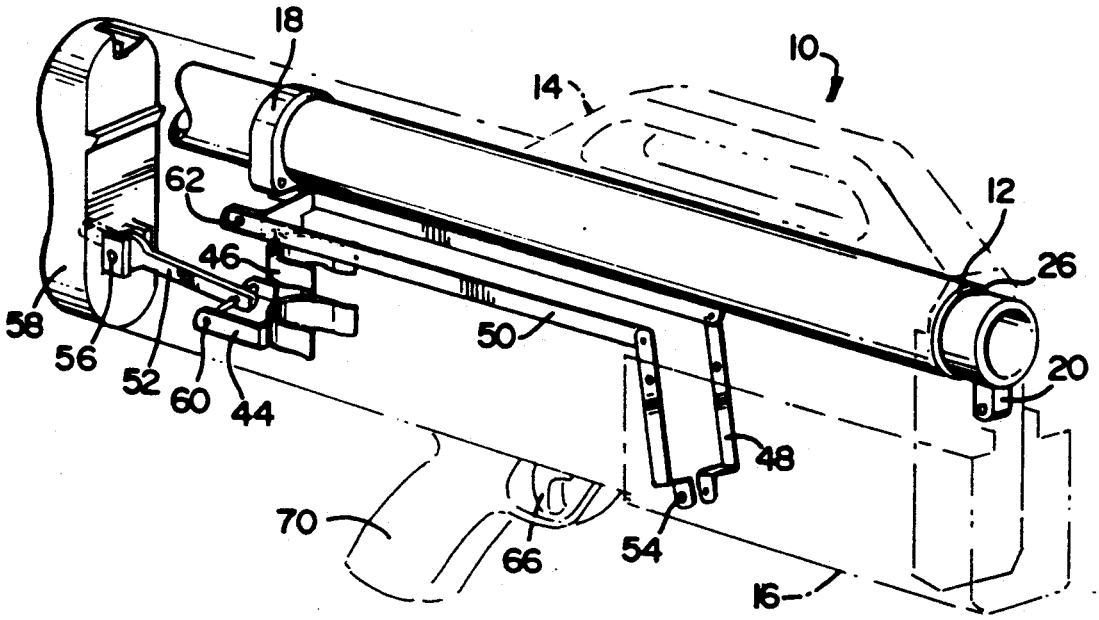
FIG. 2 shows a schematic three dimensional view of the firearm of FIG. 1 showing portion of the internal mechanism of the firearm.
Figure 3:
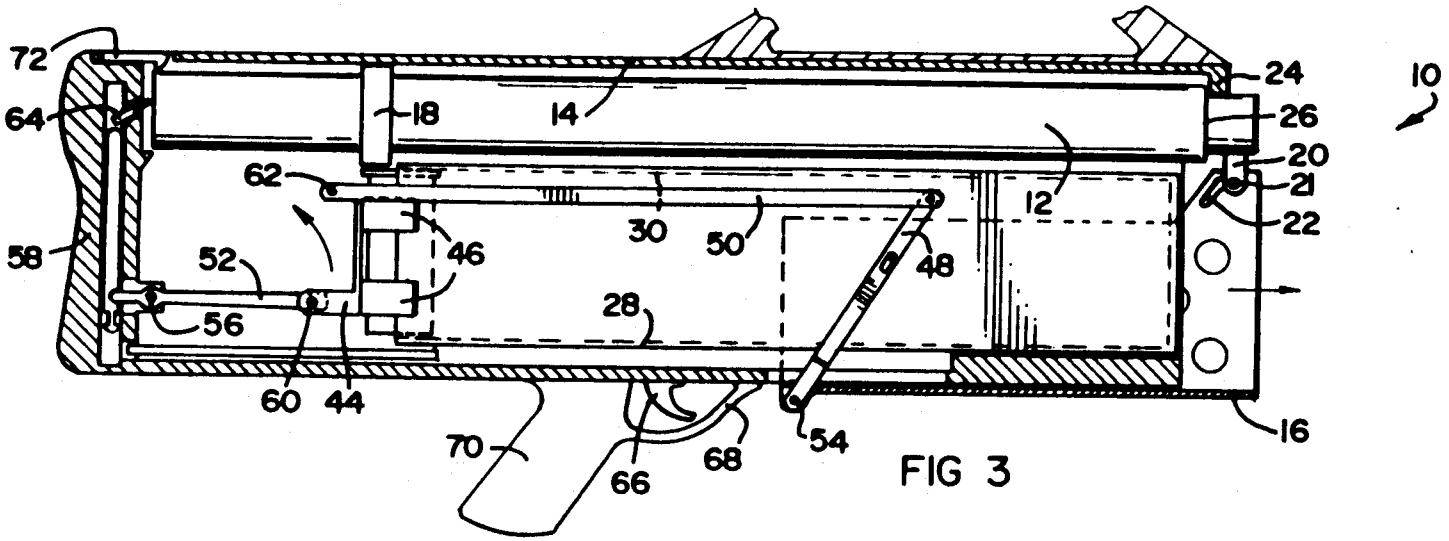
FIGS. 3 and 4 show schematic axial sections through the firearm of FIGS. 1 and 2 in two extreme positions.

As shown in FIG. 1, the chassis 14 has a port 74 through which a spent cartridge casing can be ejected. The port 74 in this embodiment is shown on the right hand side of the chassis 14 and is thus intended for a right handed person so that the spent casing is ejected towards the right of the chassis 14. It will be appreciated that the port 74 could equally be provided on the opposite left hand side of the chassis 14 as the retaining member 74 is arranged centrally.

Figure 7:
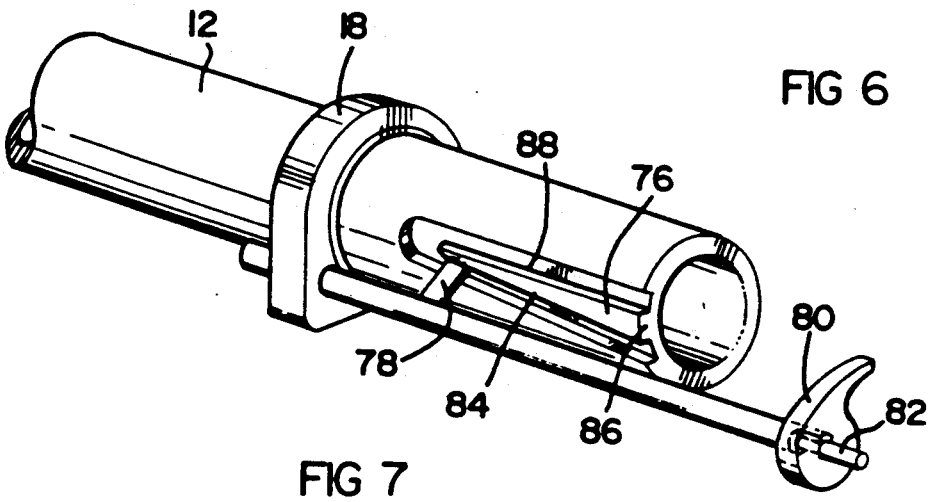
FIG. 7 shows a schematic three dimensional view of an ejection mechanism used in the firearm.

As shown schematically in FIG. 7, the rear end of the barrel has a cam member 76 which can either protrude from the outer surface of the barrel 12 or, as shown in FIG. 7, can be in the form of a V shaped recess formed in the outer surface of the barrel 12. The cam 76 is arranged, during forward movement of the barrel to engage an actuation pin 78 which causes an ejection finger 80 to rotate about a spindle 82. The pin 78 slides down the surface 84 during forward movement of the barrel, then, by reason of a spring (not shown) biassing the spindle 82, slides past a surface 86 of the cam 76 and then returns along a surface 88 to the position shown in FIG. 7. The spindle 82 is supported at its one end in the barrel support collar 18 and at its other end by the forward face of the butt 58 (not shown in FIG. 7).

Figure 8:
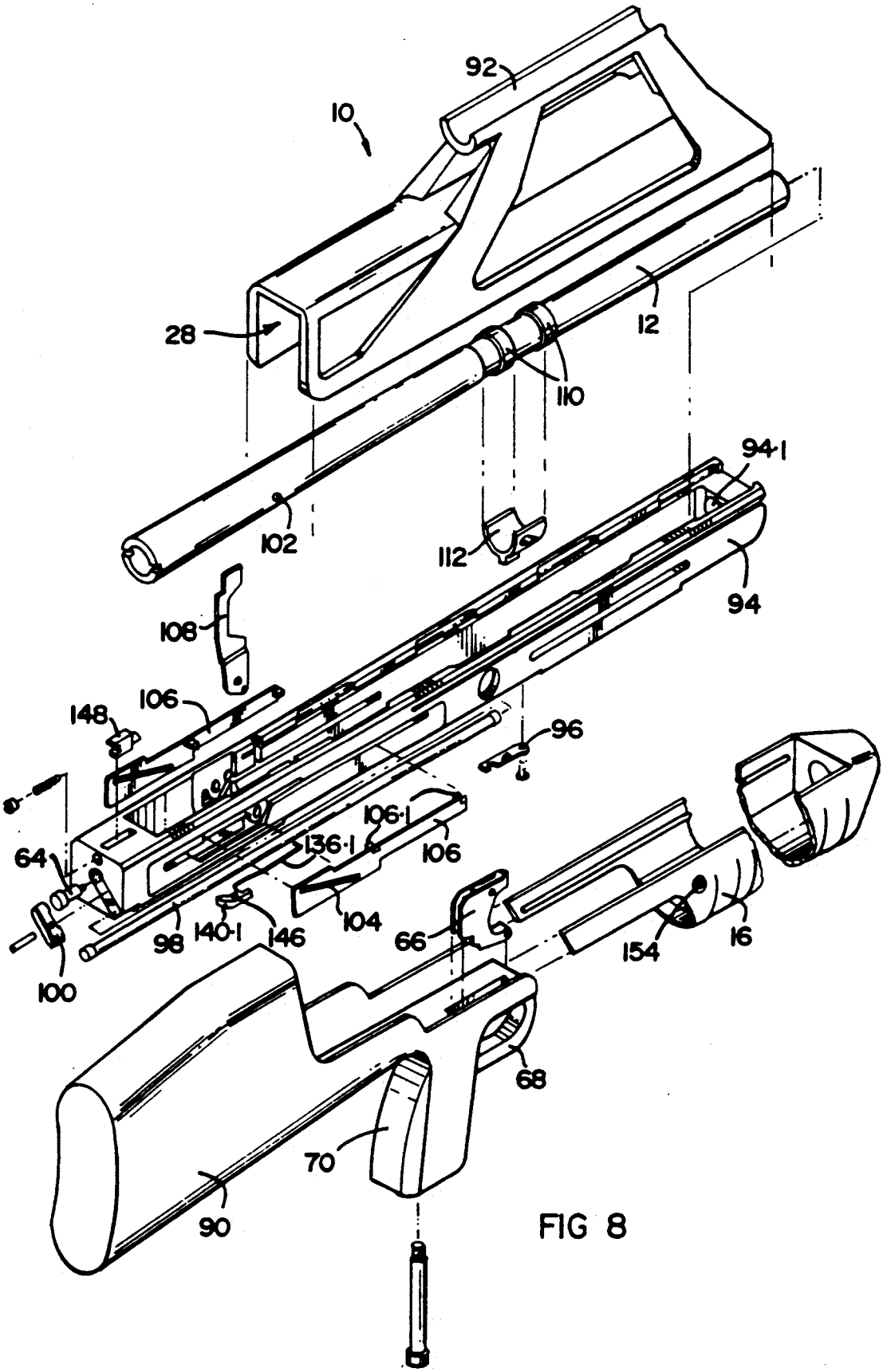
FIG. 8 shows an exploded three dimensional view of a further embodiment of a firearm in accordance with the invention.

Referring now to FIG. 8, a modification of the firearm described above is shown. While a number of parts of the firearm are similar to the previous embodiment, a number of changes have been made. Where appropriate, similar reference numerals have been used to describe similar parts of the previous embodiment. A number of parts of the firearm have been omitted from FIG. 8 to avoid overcrowding of the drawing.

In FIG. 8, the firearm has a butt 90 which is of a synthetic plastics material and is integrally molded with the pistol grip 70 and trigger guard 68. The pump member 16 is also of a synthetic plastics material as is also a carrying handle 92. The magazine well 28 is defined within the carrying handle 92 so that the magazine (not shown in FIG. 8) is now located above the barrel 12 rather than below it as in the previous embodiment. The firearm 10 further includes a chassis 94 which is of metal. The trigger 66 is pivotally mounted within a recess provided in the forward end of the butt 90 and is prevented from being pulled by an automatic trigger lock 96 which will be described in greater detail with reference to FIG. 13.

Actuation of the trigger 66 causes release of a firing rod 98 to cause pivoting of a hammer 100 thereby actuating the firing pin 64.

The barrel 12 has a pair of transverse pins 102 which, in this embodiment, co-operate with a pair of spaced lugs 106.1 provided on actuator members 106. Upon forward and rearward movement of the barrel 12, the pins 102 co-operate with the lugs 106.1 to displace the actuator members 106 forwardly and rearwardly. Slots 104 provided in the actuator members 106 cause tilting of a pair of carrier members 108 (only one of which is shown in FIG. 8).

The barrel 12 has a pair of collars 110 which serve to retain a barrel lock 112. The barrel lock 112 performs a number of functions as will be described in greater detail hereinafter. Its main function is to prevent the firearm from being fired unless the pump member 16 is in its fully rearward position. The barrel 12 is supported by the barrel lock intermediate its ends and is located at its forward end in a collar 94.1 provided in the chassis 94.

Figure 9:
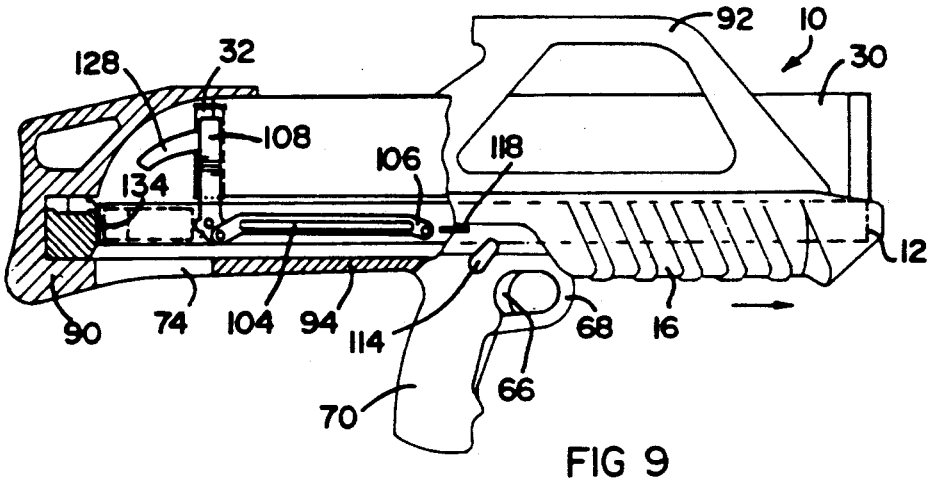
FIGS. 9, 10 and 11 show schematic partly sectioned side views of a slightly modified form of the firearm of FIG. 8.
Figure 10:
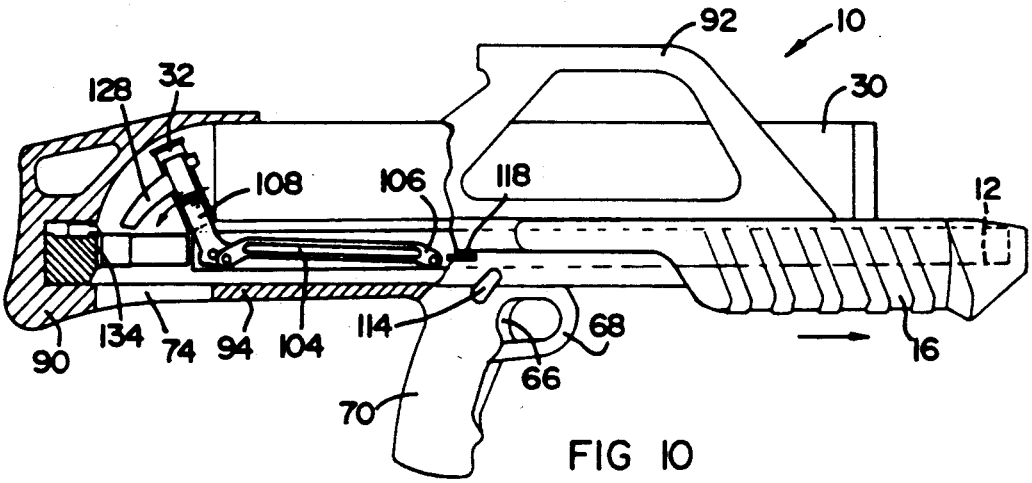
Figure 11:
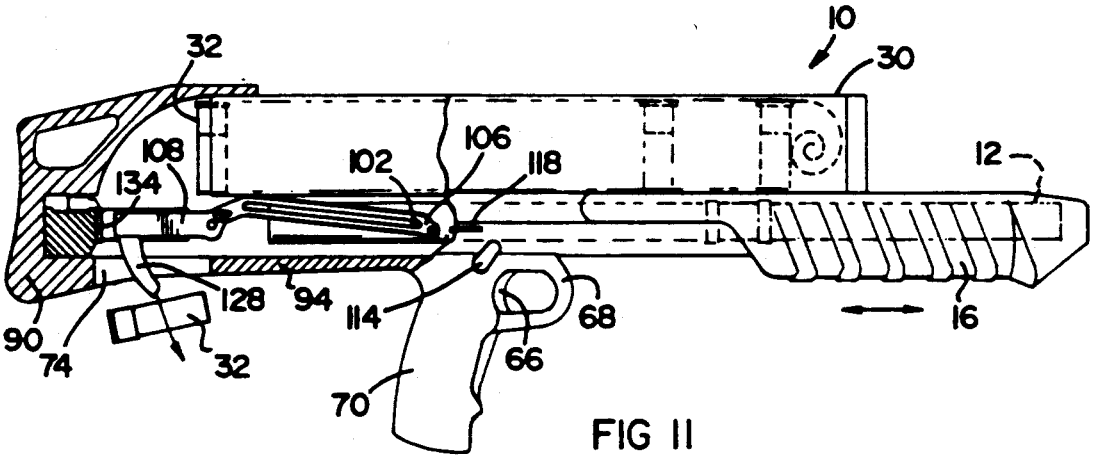

Referring to FIGS. 9, 10 and 11, a slightly modified form of the carrier members 108 and actuator members 106 is shown. The pins 102 now slide in the slots 104 in the actuator members 106 rather than co-operating with the lugs 106.1. As illustrated, forward movement of the pump member 16 together with the barrel 12 causes the pins 102 to pivot the carrier members 108 from the position shown in FIG. 9 through the position shown in FIG. 10 to the position shown in FIG. 11 to eject a fired cartridge 32 via a port 74. The port 74 is now located in the bottom section of the butt 90 thereby avoiding the necessity for providing a left handed or right handed port 74 as was the case in the previous embodiment.

The firearm further has a safety lever 114 which is fixed to a shaft 116 (see FIG. 13) to prevent actuation of the trigger 66 while the safety lever is in its safety position. The safety lever 114 is duplicated on the opposite side of the firearm so that it can be operated from either side.

Also, a lug 118 protrudes through the side wall of the upper portion of the pistol grip 70 to permit removal of a cartridge 32 within the barrel when the barrel is in its rearward position. This will be described in greater detail hereinafter.

Figure 12:
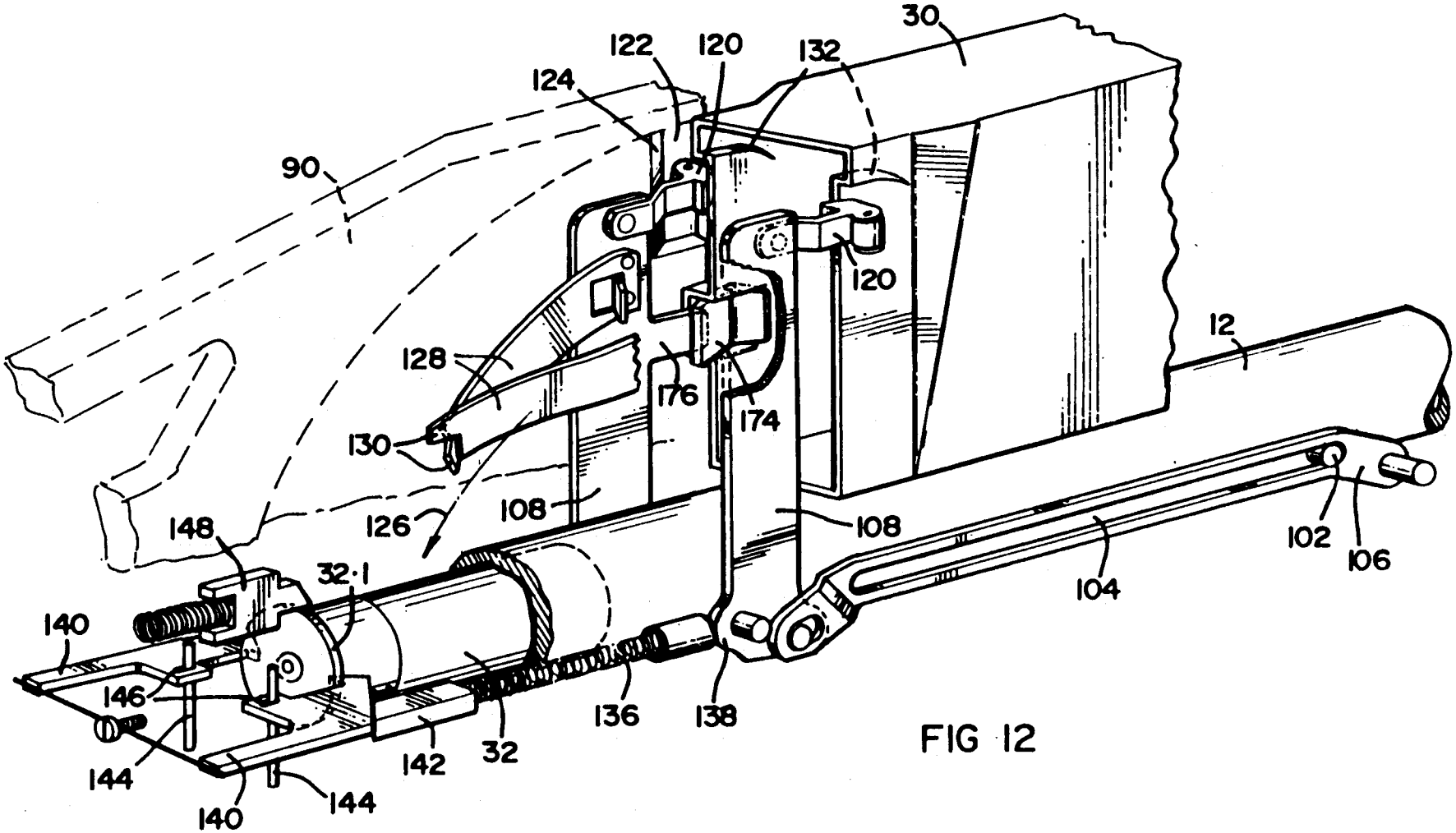
FIG. 12 shows a schematic three dimensional view of portion of the firearm illustrating its carrier mechanism.

Referring now to FIG. 12, the displacement of the cartridge 32 from the magazine 30 is shown in greater detail. The carrier members 108 have at their upper free ends a pair of gripper arms 120 which, when the carrier members 108 are in the position shown in FIG. 12, open out into a pair of recesses 122 provided in the butt 90 (only one of the recesses 122 is shown in FIG. 12). The recess 122 has a cam face 124 which engages the gripper arms 120 as the actuator members 108 move in the direction of arrow 126. This causes the gripper arms 120 to close thereby gripping a cartridge 32 and carrying it downwardly towards a position in alignment with the barrel 12.

Ejection of the spent cartridge is effected by a pair of resilient ejector fingers 128 having their ends 130 arranged in overlapping relationship. The ends 130 strike the spent cartridge 32 to eject it.

Also as shown in FIG. 12, the rear mouth of the magazine 30 has a pair of cam faces 132 which are arranged to engage the rim 32.1 of a cartridge 32 as it approaches the mouth of the magazine 30. The cam faces 132 ensure that even if cartridges of different lengths are used, each cartridge is correctly positioned relative to the carrier members 108 and will always end up in a position close to a breech face 134 (shown in FIGS. 9 to 12).

When the cartridge 32 is in alignment with the barrel 12 and before the cartridge becomes chambered in the barrel 12, ie while the barrel 12 is in its forward position, the cartridge is held against the breech face 134 by a retaining mechanism including a pair of springs 136 (only one of which is visible in FIG. 12). The springs 136 are actuated by lobes 138 provided on the carrier members 108. The retaining mechanism also includes a pair of extractor members 140 which are displaceable by the springs 136 via cam members 142. The extractor members 140 are guided on pins 144 which engage in elongated slots 146. Reverting to the FIG. 8 embodiment, a simplified form of the retaining mechanism is shown where the coil springs 136, lobes 138 and cam members 142 have been replaced by a spring wire 136.1, the forward end of which engages an aperture (not shown) in the carrier member 108. The rear end of the spring wire 136.1 engages a much simpler form of extractor member 140.1 which also has an elongated slot 146 for receiving the pin 144 (not shown in FIG. 8).

When the cartridge 32 reaches the position shown in FIG. 12, it is held against the breech face 134 of FIGS. 9 to 12 by the retaining mechanism to ensure accurate alignment of the cartridge 32 with the barrel during rearward movement of the barrel 12 The cartridge 32 is further retained by a non return latch 148 which is cammed out of the path of the cartridge while the cartridge is moving to its position in alignment with the barrel 12. The non return latch 148 prevents the cartridge from being returned towards the magazine during the return stroke of the pump member 16. During the return stroke of the pump member 16, the ejector fingers 128 are spread apart by the cartridge 32 as the carrier members 108 return to collect the next cartridge from the magazine 30 and then revert to the position shown in FIG. 12 ready to eject the cartridge 32 after firing.

After firing of the cartridge, the extractor members 140 also retain the spent cartridge in its rearward position to prevent it moving forward with the barrel 12 so that it can be ejected by the ejector fingers 128 during the subsequent pumping action of the pump member 16.

Figure 13:
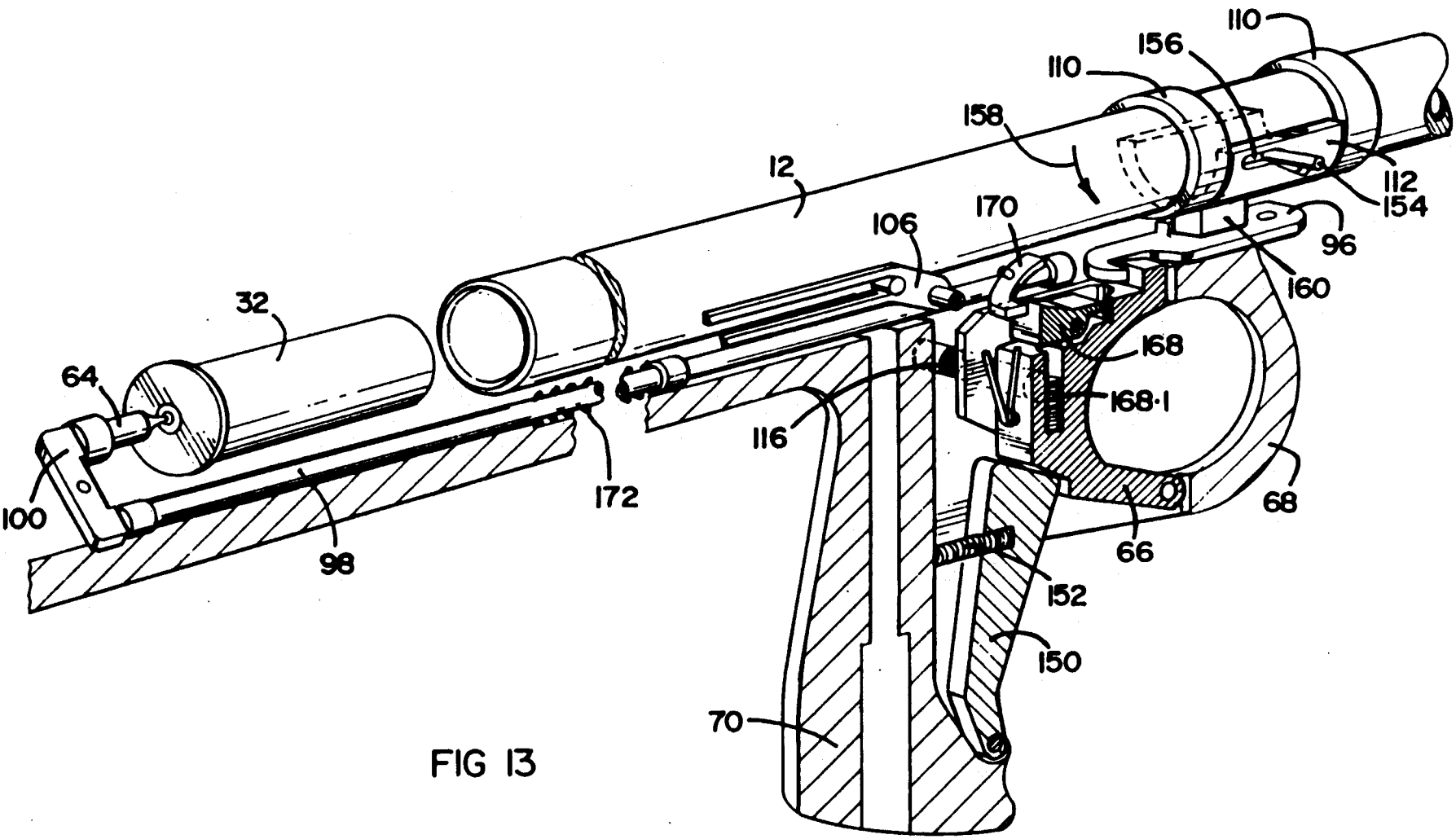
FIG. 13 shows a three dimensional partly sectioned view of the firearm illustrating its firing and trigger mechanisms.

Referring now to FIG. 13, the trigger and firing mechanisms of the firearm are shown in greater detail. Apart from the safety lever on the shaft 116 which prevents the trigger 66 from being pulled, there is also a grip safety member 150 biassed by a spring 152 into the path of the trigger 166. Once the butt 70 is gripped and the grip safety member 150 has been moved rearwardly, the trigger 66 can be pulled provided of course the safety lever shaft 116 is out of its path. The grip safety member 150 prevents accidental firing while the trigger grip 70 is not being gripped firmly.

Figure 15:
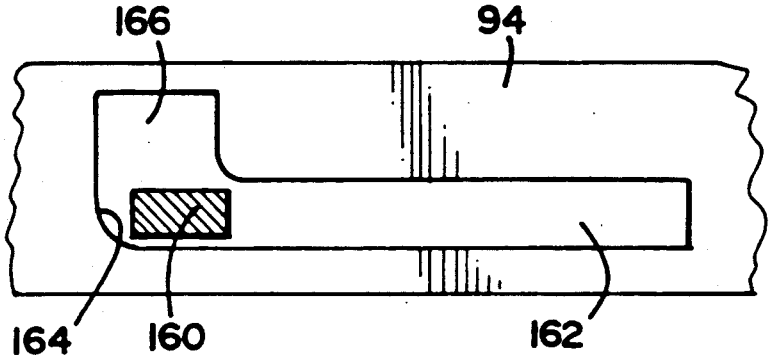
FIG. 15 shows a partly sectioned schematic plan view of portion of the barrel lock of the firearm.

The automatic trigger lock 96 also has a forward end which is in the path of the trigger 66 to prevent the trigger 66 from being pulled until the barrel 12 is in its fully rearward position. The barrel lock 112 is rotatably mounted co-axially with the barrel 12 between the collars 110. During forward movement of the pump member 16, a pin 154 which is fixed to the pump member 16 and which engages a cam slot 156 provided in the barrel lock 112 causes rotation of the barrel lock 112 in the direction of arrow 158. The barrel lock 112 has a depending lug 160 which, as shown in FIG. 15, rides in an elongated slot 162 provided in the chassis 94. The depending lug 160 during its rearward movement engages a cam face 164 to cause the lug 160 to move into a recess 166. While in the recess 166, the lug 160, as shown in FIG. 13, acts to displace the automatic trigger lock 96 out of the path of the trigger 66. Thus only when the barrel 12 has been moved fully rearwardly by the pump member 12, can the trigger be pulled to fire the firearm.

When the trigger 66 is pulled, it acts on a disconnecter member 168 to pivot a sear 170 out of the path of the firing rod 98 which then by reason of its spring 172 flies backwardly to actuate the hammer 100 and to move the firing pin 64 towards the cartridge 32 to fire it. The firing pin 64 is returned after firing by a spring (not shown). The disconnecter member 168 is biassed by a spring 168.1 so that when the trigger 66 is released the disconnecter member 168 underrides the sear 170 ready for re-firing. In practice, the sear 170 engages a side face of the end of the firing rod 98 rather than an upper end portion thereof as illustrated.

As soon as the pump member 16 is moved forwardly, the pin 154 which is fixed to the pump member 16 engages the slot 156 to cause the barrel lock 112 to pivot in the direction of arrow 158 thereby to re-engage the automatic trigger lock 96.

Figure 14:
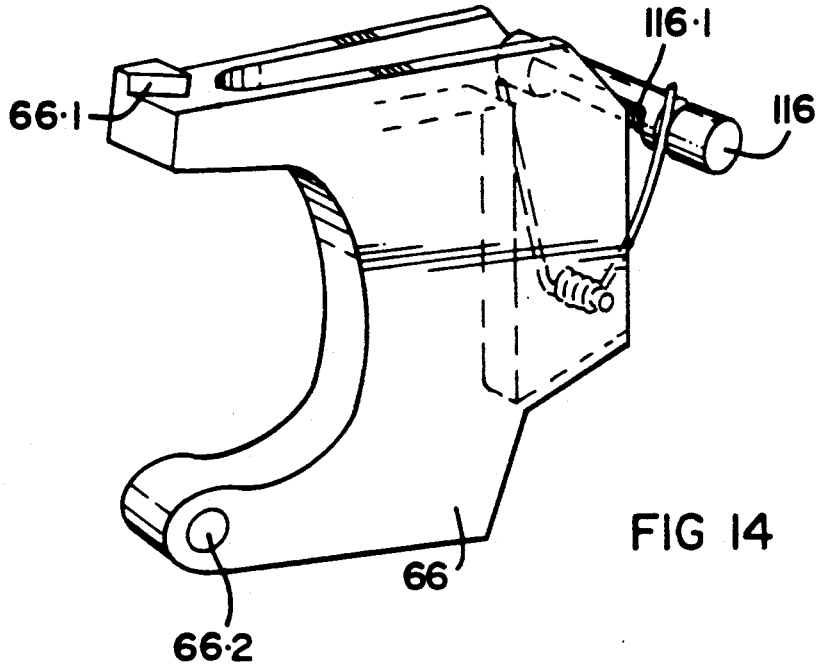
FIG. 14 shows a three dimensional view of the trigger of the firearm.

As shown in FIG. 14, the shaft 116, which is attached to the safety lever 114 of FIGS. 9 to 12, has a flat 116.1 formed thereon which allows the trigger 66 to pivot about its pivotal mounting 66.2 when the safety lever 114 is not in its safety position. The trigger 66 also has a camming formation 66.1. If the trigger 66 is maintained in its actuated position while the pump member 16 is moved forwardly, the camming formation cams the automatic trigger lock 96 out of its path when the trigger 66 is released to permit the automatic trigger lock 96 then to re-engage the trigger 66.

Figure 16:
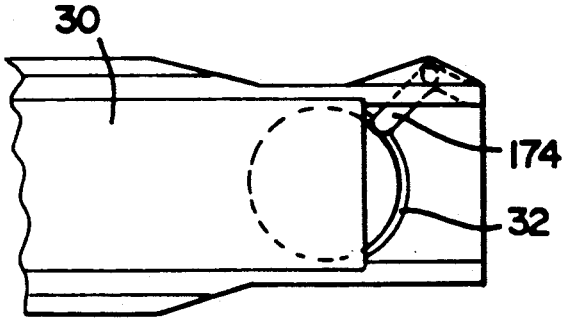
FIG. 16 shows a schematic plan view of portion of the magazine of the firearm.

In FIG. 16, the rearward end of the magazine is shown with a cartridge 32 ready to be dispensed from its mouth. The rearmost cartridge is retained in a waiting position by a catch 174 which is biassed into the position shown by a spring (not shown) to prevent ejection of the rearmost cartridge 32. It will be noted from FIG. 12 that the catch 174 is pivoted out of the path of the rearmost cartridge by a finger 176 protruding from one of the carrier members 108 thereby to permit the rearmost cartridge to exit from the mouth of the magazine 30 and to be received between the carrier members 108. The exiting cartridge also causes the catch 174 to pivot back into the path of the next cartridge contained in the magazine. When loading cartridges into the magazine 30 (with the magazine removed from the firearm) the catch 174 is simply cammed out of the path of the cartridge by the cartridge itself and the catch 174 then prevents the cartridge from being ejected out of the magazine 30 by the magazine springs (not shown in FIG. 16).

Figure 17:
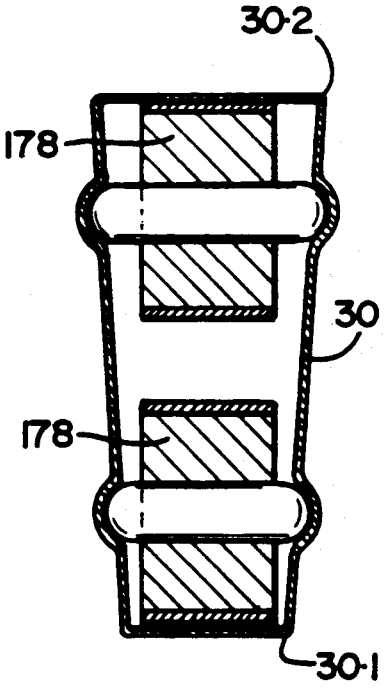
FIGS. 17 and 18 show respectively a sectional end view and a partly sectioned side view of the mouth of the magazine.
Figure 18:
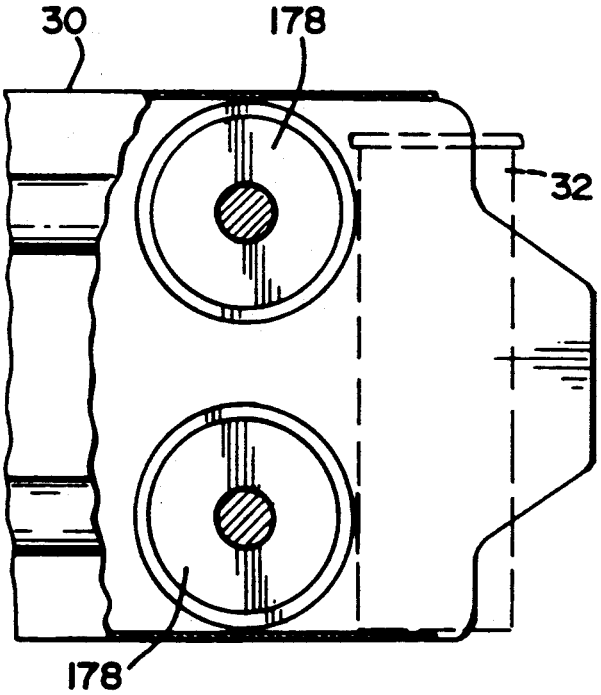

In FIGS. 17 and 18, the rearward end of the magazine 30 is shown. Again, the magazine is broader at its end 30.2 than at its end 30.1 to accommodate the rims of the cartridges 32 thus avoiding the necessity of a curved magazine. Also, instead of a single spring, a pair of tape springs acting on rollers 178 are used to urge the cartridges 32 towards the rearward mouth of the magazine 30.

Figure 19:
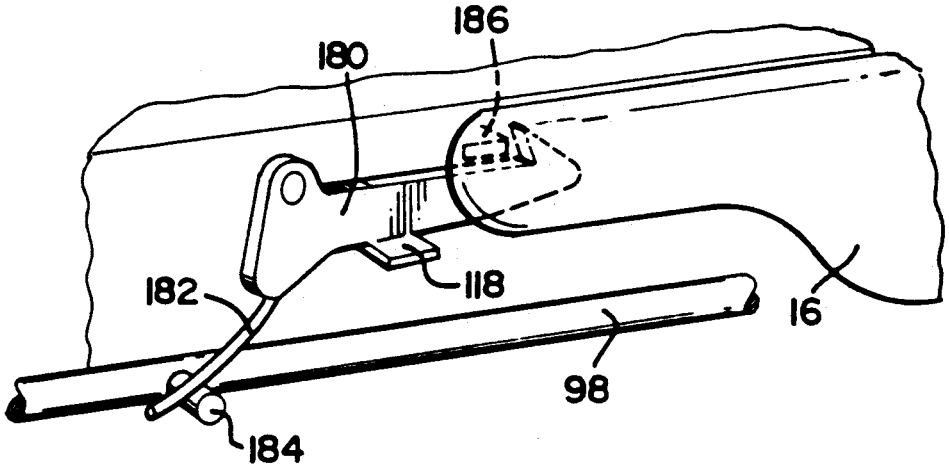
FIG. 19 shows a three dimensional schematic view of a locking mechanism for locking the pump member of the firearm.

Referring to FIG. 19, it can be seen that the lug 118, which as was shown in FIG. 9 to 12 protrudes through the side wall of the upper portion of the pistol grip 70, is used to displace a catch 180. The catch 180 has a spring 182 attached to it which is in the path of a pin 184 provided on the firing rod 98. When the firing rod 98 springs rearwardly when the trigger is pulled, the pin 184 engages the spring 182 to displace the catch 180 out of the path of a protuberance 186 attached to the pump member 16. Thus, only after firing when the firing rod 98 has moved rearwardly can the pump member 16 be moved forward. Alternatively, if it is desired to remove a chambered cartridge from the barrel without firing, the lug 118 can be depressed manually to permit the pump member 16 to be moved forwardly thereby to release the cartridge contained in the barrel 12.

The firearm illustrated in FIGS. 8 to 19 again has a relatively short overall length without sacrificing barrel length. The magazine 30, which can contain 20 cartridges, is located above the barrel rather than below the barrel as in the previous embodiment. When the pump member 16 is pumped forwardly, the barrel lock 112 is rotated thereby to cause the automatic trigger lock 96 to re-engage the trigger 66 to prevent the trigger being pulled. As the barrel moves forward, the firing rod is retensioned. Also, while the barrel moves forward, a fresh cartridge is removed from the magazine and placed in alignment with the barrel while the spent cartridge is ejected.

During rearward movement of the pump member 16, the carrier members 108 are returned to collect the next cartridge contained in the magazine 30 and simultaneously displace the catch 174 to allow the next cartridge to exit the mouth of the magazine 30 and to be received within the gripping arms 120. The retaining mechanism including the extractor members 140 and non return latch 148 also ensures that the cartridge is squarely positioned against the breech face 134 ensuring that the forward end of the cartridge is aligned with the barrel before it becomes chambered in the barrel.

The invention illustrated provides a firearm which, by reason of the arrangement of the cartridges in the magazine well can be relatively short yet can contain a relatively large number of cartridges without correspondingly increasing the length of the firearm. The barrel is still of an adequate length for accurate firing. Also, the pumping action of the firearm is reversed compared to conventional pump action weapons and this, it is believed, makes the firearm inherently safer to handle. Transference of the cartridges from their stacked position within the magazine to the firing position is effected by a simple carrier mechanism. The cartridges within the magazine are not moved upwardly against gravity as in conventional shotguns having a box magazine, but are merely moved against friction within the magazine in a horizontal direction. The firearm illustrated is also boltless because the barrel is moved forwardly to load the firearm. Because of the lack of a bolt, the need for a conventional receiver falls away as there is no bolt which must be contained for the full stroke of the pump member 16.

What we claim is:

1. A pump action firearm which includes a barrel, a chassis defining a magazine well for receiving a magazine, the magazine well extending longitudinally parallel to the barrel and operable to contain a magazine that holds a plurality of cartridges arranged in stacked relationship with each cartridge having its longitudinal axis extending substantially transversely to a longitudinal axis of the barrel, a pump member operable to displace the barrel forwardly and rearwardly, and a carrier mechanism linked to the pump member and operable, during pumping of the pump member, to move an end cartridge contained in the magazine from its stacked position to an operative position in alignment with the longitudinal axis of the barrel.

2. A firearm as claimed in claim 1, in which the carrier mechanism includes at least one gripping formation operable to receive the end cartridge contained in the magazine, the gripping formation being fixed to a carrier member which is tiltable by the pump member thereby to displace the end cartridge from its stacked position to its operative position in alignment with the barrel.

3. A firearm as claimed in claim 2, in which the gripping formation includes a pair of gripping arms for receiving the end cartridge therebetween, the arms cooperating with a camming face provided in a butt of the firearm and operable to allow the arms to open to receive the end cartridge therebetween as the arms approach the end cartridge and then to close the arms thereby to grip the end cartridge during a subsequent pumping action thereby to permit transfer of the end cartridge from the magazine to its operative position in alignment with the barrel.

4. A firearm as claimed in claim 3, in which the magazine has a catch located at its mouth and operable to retain the end cartridge in the mouth of the magazine, the catch being displaceable by a forwardly protruding finger provided on the carrier member as it approaches the mouth of the magazine thereby to permit the end cartridge to exit the mouth and to be received between the gripping arms.

5. A firearm as claimed in claim 1, which includes a retaining mechanism operable to retain the cartridge in its operative position in alignment with the barrel to permit proper chambering of the cartridge in the barrel prior to firing and operable to prevent movement of the cartridge when the barrel is moved forwardly after firing, the retaining mechanism including a pair of extractor members operable to engage a rim of the cartridge and to urge it against a breech face provided in the butt, and a non return latch operable to prevent return of the cartridge towards the magazine when the carrier mechanism is returned to collect a further cartridge on a return stroke of the pump member.

6. A firearm as claimed in claim 1, which includes an ejector mechanism for ejecting a spent cartridge after firing, the ejector mechanism including a pair of ejection fingers fixed to the carrier mechanism and operable to eject the spent cartridge via an ejection port provided in the chassis while the carrier mechanism carries a fresh cartridge from the magazine into a position in alignment with the barrel.

7. A firearm as claimed in claim 1, in which the barrel is supported at its forward end by a collar provided in the chassis of the firearm and by a barrel lock intermediate its ends, the barrel lock being in the form of a semicircular collar rotatably mounted on the barrel and axially located between two spaced collars fixed to the barrel, the barrel lock having a depending lug which rides in an elongated slot provided in the chassis, the slot having at one end a cam formation operable to cam the barrel lock into its locked position.

8. A firearm as claimed in claim 7, in which the barrel lock has a cam slot formed in its side wall, the slot being engaged by a pin fixed to the pump member thereby to cause unlocking of the barrel lock during pumping of the pump member.

9. A firearm as claimed in claim 1, in which the magazine has a longitudinally extending wider portion to accommodate rims of a plurality of cartridges, alternate stacked cartridges then being arranged in the magazine in tilted positions in planes extending at an acute angle relative to each other, the magazine having side walls which taper inwardly towards its mouth to orientate the end cartridge to a central position intermediate the extreme tilted positions as the end cartridge approaches the mouth of the magazine.

* * * * *